United States Patent [19]

Smith

[11] 3,958,630

[45] May 25, 1976

[54] HEAT EXCHANGER BAFFLE ARRANGEMENT

[75] Inventor: Hosea E. Smith, Baytown, Tex.

[73] Assignee: Exxon Research and Engineering Company, Linden, N.J.

[22] Filed: Jan. 24, 1975

[21] Appl. No.: 543,836

[52] U.S. Cl. ..... 165/161
[51] Int. Cl.[2] ..... F28F 9/22
[58] Field of Search ..... 165/158–161

[56] References Cited

UNITED STATES PATENTS

| | | | |
|---|---|---|---|
| 2,411,097 | 11/1946 | Kobb | 165/161 |
| 2,910,275 | 10/1959 | Munro | 165/161 |
| 2,916,264 | 12/1959 | Rhodes | 165/161 |
| 3,020,024 | 2/1962 | Lawrance | 165/161 X |
| 3,545,536 | 12/1970 | Peters | 165/159 X |
| 3,805,887 | 4/1974 | Smith | 165/76 |

*Primary Examiner*—Charles J. Myhre
*Assistant Examiner*—Theophil W. Streule, Jr.
*Attorney, Agent, or Firm*—James E. Reed

[57] ABSTRACT

A shell and tube heat exchanger includes a tube bundle having a stationary tube sheet near one end thereof; a second tube sheet near the other end thereof; a plurality of tubes extending between the stationary tube sheet and the second tube sheet; a plurality of segmented transverse baffles located between the stationary tube sheet and the second tube sheet, the cut of each transverse baffle being located about 180° from those on the adjacent transverse baffles; a double segmented auxiliary baffle located near at least one end of the tube bundle, the cut of the double segmented baffle extending substantially parallel to the cut on the adjacent transverse baffle and the auxiliary and transverse baffles being located at substantially equal intervals; and a longitudinal baffle member extending from the cut of the transverse baffles adjacent the auxiliary baffles to the corresponding cut on the auxiliary baffles.

10 Claims, 5 Drawing Figures

HEAT EXCHANGER BAFFLE ARRANGEMENT

BACKGROUND OF THE INVENTION

1. Field of the Invention

This invention relates to shell and tube heat exchangers and is particularly concerned with an improved baffle arrangement for the tube bundles of such heat exchangers which results in improved heat transfer, reduces corrosion, and has other advantages.

2. Description of the Prior Art

Shell and tube exchangers are widely used for the indirect transfer of heat from one fluid to another. Typically, such a heat exchanger consists of an external shell having inlet and outlet ports for circulation of the shell side fluid. An elongated bundle of tubes is positioned within the shell and provided with transverse baffles for directing the shell side fluid back and forth across the tubes. The tubes are supported by tube sheets, one of which is normally stationary and the other of which may be stationary or "floating" to accommodate changes in tube length due to thermal expansion. The tube bundle and shell may be arranged so that the tube side fluid makes a single path through the shell or instead makes two or more passes. In a single pass exchanger, the tube side fluid is introduced into a head at one end of the shell and withdrawn from a head at the other end. In a multiple pass unit, the exchanger will generally be provided with an external head containing one or more baffles so that the tube side fluid can be introduced into one portion of the head and withdrawn from the other portion. An internal head within which the tube side fluid flows from one set of tubes into another will generally be located at the other end of the tube bundle. A wide variety of different shell and tube arrangements have been employed in the past.

Most shell and tube heat exchangers used in petroleum refineries and similar process applications are built with the shell side inlet and outlet nozzles located a substantial distance from the inlet and outlet tube sheets because of the necessity for preserving the mechanical strength and integrity of the shell. The length of the shell and flanges, mandatory spacing between welds, nozzle diameters, and other factors establish minimum distances between each tube sheet and the opposite side of the adjacent nozzle. The transverse baffles which direct the flow of shell side fluid back and forth across the tube bundle are usually located so that the first and last baffles are placed adjacent the shell inlet and outlet nozzle openings on the side away from the tube sheets. This results in abnormally wide baffle spacing adjacent the tube sheets where the shell side fluid enters and leaves the exchanger. A "dead" space normally exists adjacent the tube sheet where little circulation of fluid takes place. Experience has shown that corrosion is generally most severe in this area and that relatively little heat transfer takes place at this point. In many exchangers, these problems are accentuated by the use of "floating end support plates". These support plates are installed in exchangers having floating heads and are located in the tube bundles between the floating tube sheet and the shell nozzle in order to support the overhanging end of the tube bundle. Such an arrangement produces another dead space between the tube support plate and the floating tube sheet where essentially no circulation of shell side fluid takes place. Corrosion in this area is often much more severe than at any other place in the exchanger. As a result of the corrosion which occurs here the useful life of tube bundles is often quite short, even though corrosion resistant metals and alloys are normally used. Efforts to avoid these and related problems have in the past been only partially successful.

SUMMARY OF THE INVENTION

This invention provides improved shell and tube heat exchangers which alleviate many of the problems referred to above. In accordance with the invention, it has now been found that corrosion problems and related difficulties associated with conventional shell and tube heat exchangers can be at least partially avoided by providing the tube bundle of such a heat exchanger with a plurality of segmented transverse baffles between the tube sheets, the cut of each transverse baffle being located about 180° from that of the adjacent transverse baffle; with a double segmented auxiliary baffle near each end of the tube bundle, the cuts of the double segmented baffles extending substantially parallel to the cuts of the adjacent transverse baffles and the auxiliary and transverse baffles being located at substantially equal intervals between the tube sheets; and with longitudinal baffle members extending from the cuts of the transverse baffles adjacent the auxiliary baffles to the corresponding cuts of the auxiliary baffles. The auxiliary baffles, longitudinal baffle members, and adjacent transverse baffles adjacent the tube sheets divert the incoming and outflowing shell side fluid adjacent the tube sheets and thus eliminate the dead spaces which have characterized shell and tube exchangers employed in the past. This in turn greatly reduces corrosion of the tubes in the bundle, results in more uniform shell side fluid velocities and thus produces better heat transfer and reduces overall pressure drop, eliminates the necessity for the floating end support plates which are indirectly responsible for much of the corrosion encountered in conventional shell and tube exchangers, makes feasible the rotation of the tube bundle through 180° at periodic intervals in order to increase tube life, and has other advantages over conventional shell and tube exchangers. These advantages permit substantial reductions in the overall cost of heat exchange operations.

The system of the invention is applicable to shell and tube exchangers having both stationary and fixed heads and can be employed with exchangers having either single pass or multiple pass arrangements for the shell side fluid, the tube side fluid, or both.

DESCRIPTION OF THE PREFERRED EMBODIMENTS

Figures 1, 2, 3, 4, 5:
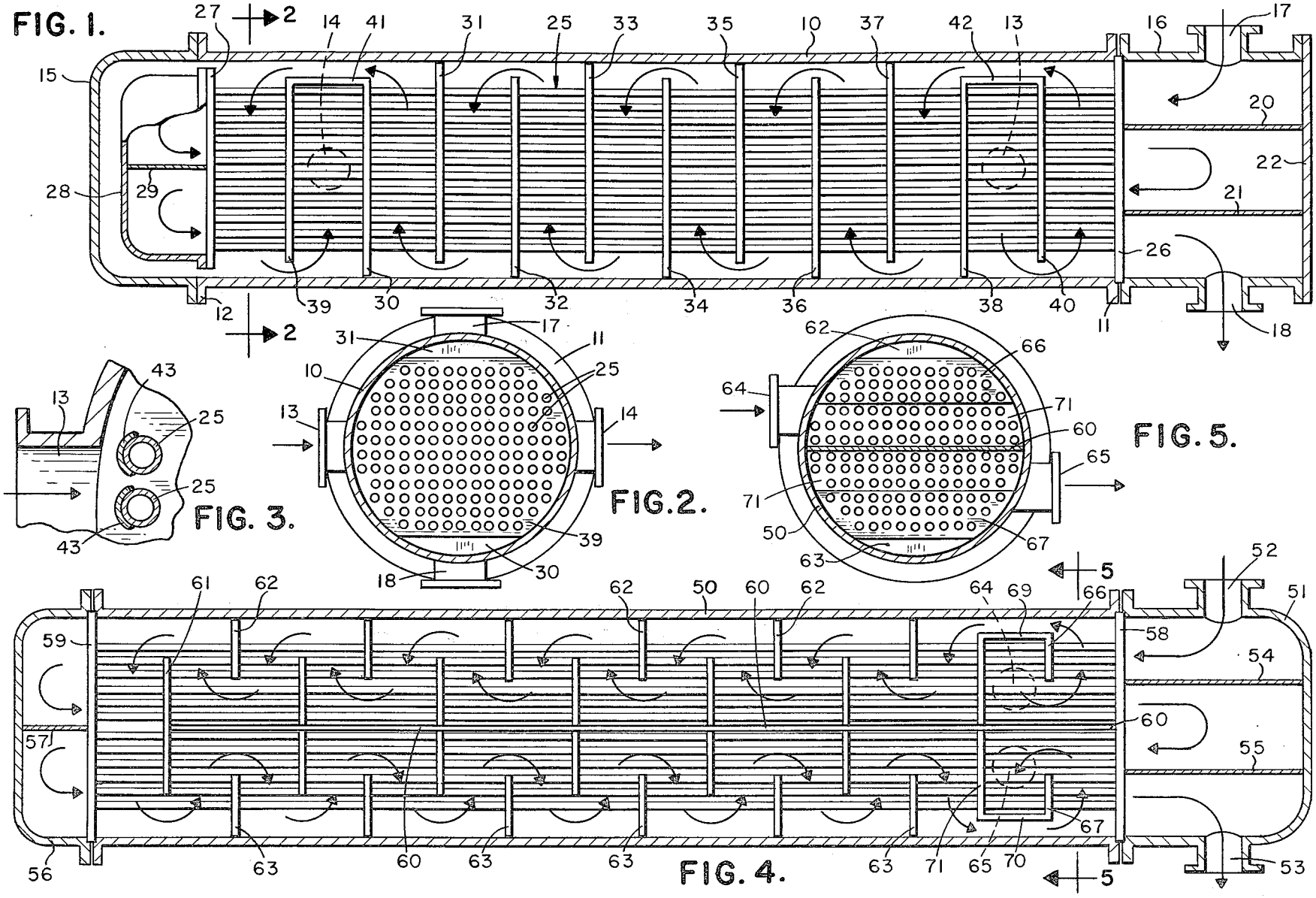
FIG. 1 in the drawing is a schematic diagram, partially in section, of a preferred embodiment of a shell and tube heat exchanger constructed in accordance with the invention.
FIG. 2 is a cross-sectional view of the exchanger of FIG. 1 taken about the line 2—2.
FIG. 3 is an enlarged fragmentary cross-sectional view of a portion of the exchanger of FIGS. 1 and 2 adjacent the shell side fluid inlet which illustrates the method used to protect the outer tubes near the inlet against damage due to fluid impingement.
FIG. 4 is a longitudinal sectional view of another shell and tube heat exchanger constructed in accordance with the invention.
FIG. 5 is a cross-sectional view of the exchanger of FIG. 3 taken about a line 5—5.

The heat exchanger shown in FIGS. 1 through 3 of the drawing is a multiple pass unit in which the tube side fluid makes four passes through the exchanger and the shell side fluid makes a single pass. The unit shown includes an elongated, generally cylindrical outer shell 10 fitted with an external flange 11 at one end and a similar external flange 12 at the other end. The shell contains a fluid inlet 13 located near flange 11 and a fluid outlet 14 located near flange 12. The minimum spacing of the inlet and outlet from the flanges is determined by applicable engineering codes and standards and will depend in part upon the dimensions of the shell, the dimensions of the inlet and outlet fittings, the materials of construction employed, the minimum spacing between welds, the conditions under which the unit is designed to operate, and other considerations. In most instances these factors will dictate that the inlet and outlet be located a substantial distance inward of the flanges. In the particular unit shown, the inlet and outlet fittings are located at opposite ends of the shell and are positioned on opposite sides of the structure but, as pointed out hereafter, other arrangements may be employed. The shell 10 is fitted with a flanged head 15 at one end and a heat exchanger head 16 containing tube side fluid inlet 17 and outlet 18 at the other end. Outlet 18 contains internal baffles 20 and 21 which are arranged to permit four passes of the tube side fluid through the exchanger. The particular exchanger head shown in FIG. 1 also includes a removable plate 22 for easy access to the interior of the head. The materials of construction employed for the exchanger of FIG. 1 will depend primarily upon the fluids to be handled and the operating conditions to be employed and may be varied as necessary.

The tube bundle in the exchanger of FIGS. 1 through 3 in the drawing comprises a plurality of elongated heat exchanger tubes 25 extending between a stationary tube sheet 26 and a floating tube sheet 27. The ends of the tubes are secured to the tube sheets in the conventional manner. A removable floating head 28 containing an internal baffle 29 for directing fluid flow within the tube bundle is bolted or otherwise attached to floating tube sheet 27. The stationary tube sheet 26 is held in place between flange 11 and heat exchanger head 16 by bolts, not shown, extending through the flange and head. Orienting means as described in U.S. Pat. No. 3,805,887 will normally be provided to ensure that the tube bundle is properly positioned within the shell. The orienting means, which does not appear in the drawing, permits installation of the tube bundle within the shell in two different positions spaced 180° apart and avoids misalignment of the bundle with respect to the shell inlet and outlet. Experience has shown that most tube corrosion occurs near the bottom of the tube bundle and that the tube life can be extended considerably by rotating the bundle 180° after the exchanger has been in service for some time.

The tube bundle of the heat exchanger of FIGS. 1 through 3 in the drawing is provided with a plurality of segmented transverse baffles 30 through 38 which are spaced at regular intervals along the tube bundle between the shell inlet and outlet. As used herein, a "segmented" baffle is one having a segment bounded by an arc and a chord removed from the baffle. The chord is generally referred to as the "cut" of the baffle. A "double segmented" baffle is one having two segments removed. each segment being defined by an arc and a chord and the two chords or cuts being parallel to one another. The transverse baffles are arranged on the tube bundle so that the cuts extend substantially parallel to one another and the cut of each transverse baffle is located about 180° from that of the adjacent transverse baffle. The tube bundle also includes double segmented baffles 39 and 40 which are located respectively between the floating tube sheet 27 and the shell outlet 14 and the stationary tube sheet 26 and the shell inlet 13. The cuts of the double segmented baffles extend parallel to those of the transverse baffles 30 through 38. The baffles are held in place by conventional supporting rods which extend between the tube sheets and are not shown in the drawing. The spacing of the double segmented and transverse baffles on the tube bundle is such that the distance between each tube sheet and the adjacent double segmented baffle is substantially the same as that between each two adjacent baffles. The cuts on the baffles are preferably such that the free space available for the flow of fluid around each cut is approximately the same as the free space available for the flow of fluids through the tube bundle between adjacent baffles but this is not always essential. The free space available for flow between baffles will depend in part upon the spacing of the baffles and the arrangement of the tubes in the bundle. Since the shell and tube bundle are both of generally circular cross-section, the available free space will also depend in part upon the point at which it is measured. The spacing between double segmented baffle 39 and adjacent transverse baffle 30 is closed off by a longitudinal baffle member 41 extending between the corresponding cuts on the double segmented and transverse baffles. Similarly, the space between double segmented baffle 40 and adjacent transverse baffle 38 is closed off by longitudinally extending baffle member 42. These two longitudinal baffle members and the adjacent double segmented and transverse baffles enclose the shell inlet and outlet on three sides and force the fluid entering and leaving the exchanger shell to flow adjacent the tube sheets. Since the spacing between all of the baffles is substantially the same, the velocity of the shell side fluid as it moves back and forth across the tube bundle is substantially constant. This results in considerably better heat transfer than is normally obtained with conventional shell and tube heat exchangers and alleviates to a large degree the tube corrosion problems due to the existence of dead spaces within the shell adjacent the exchanger tubes.

The exchanger shown in FIGS. 1 through 3 of the drawing is depicted with the shell inlet and outlet extending horizontally. It should be noted, however, that vertical inlet and outlet fittings may be used if desired. The baffles on the tube bundle must be positioned with respect to the inlet and outlet so that the fluid entering and leaving the shell flows around the double segmented baffles and passes adjacent the tube sheets. For a particular orientation of the shell inlet and outlet, there are thus two positions 180° apart in which the tube bundle may be mounted. As pointed out earlier, it is advantageous to rotate the bundle 180° after the unit has been in service for a period of time such that corrosion of the tubes on the bottom of the bundle may be expected.

The exchanger shown in FIGS. 1 through 3 does not employ a floating support sheet to support the tube bundle near the floating head. The support required is provided instead by double segmented baffle 39. This elimination of the floating support sheet does away with the dead area normally present in shell and tube exchangers and thus eliminates an additional source of corrosion difficulties. The space between flanged head 15 and floating head 28 is essentially a dead space in the exchanger shown but this does not give rise to serious corrosion problems because no exchanger tubes are located within this space.

It should also be noted that the exchanger shown in FIGS. 1 through 3 does not include the impingement plates or baffles generally employed in conventional exchangers. These plates create an added pressure drop within the exchanger near the inlet and limit the space available for tubes. In lieu of impingement plates, the tubes adjacent the shell inlet are protected against fluid erosion as shown in FIG. 3 of the drawing. The tubes exposed to the incoming fluid through inlet 13 are provided with protective members 43 made by splitting tubes of larger diameter and welding or otherwise mounting portions of the split tubes on the exposed exchanger tube surfaces. This provides adequate protection against fluid erosion without the disadvantages associated with conventional impingement plates.

It will be understood that the invention is not restricted to the particular configuration shown in FIGS. 1 through 3 of the drawing. FIGS. 4 and 5 depict a further embodiment of the invention in which the tube side and shell side fluid both make multiple passes through the exchanger. This exchanger includes an elongated generally cylindrical outer shell 50 fitted with an exchanger head 51 containing a tube side fluid inlet 52, a tube side fluid outlet 53 and internal baffles 54 and 55 to control the movement of fluid within the head. The opposite end of the shell is closed off by a dished head 56 containing an internal baffle 57. The tube bundle of this exchanger extends from a first stationary tube sheet 58 to a second stationary tube sheet 59. Because of the temperatures at which the exchanger is designed to operate, a floating head is not required. Because the shell side fluid in this unit makes two passes through the exchanger, a longitudinal baffle 60 is incorporated within the tube sheet. This baffle extends the full width of the device and fits closely against the shell inner walls. The transverse baffles employed are of somewhat different shape than those used in the earlier embodiment. The transverse baffle 61 attached to the end of longitudinal baffles 60 near tube sheet 59 is a double segmented baffle around which the shell side fluid moves from the upper portion of the exchanger into the lower portion of the exchanger. The adjacent baffles 62 are segmental in shape and divert the fluid from the upper portion of the shell near the shell wall to the inner portion near longitudinal baffle 60. A similar segmental baffle 63 is positioned to divert fluid in the lower portion of the shell from points near the wall upwardly toward the longitudinal baffle. The portion of the tube bundle between tube sheet 59 and the shell inlet 64 and outlet 65 contains alternate double segmented and segmental baffles which cause the fluid to move back and forth across the upper and lower portions of the tube bundle. Smaller double segmented baffles 66 and 67 are positioned between the inlet and outlet and tube sheet 58. Longitudinal baffle members 69 and 70 close off the space between the double segmented baffle 71 on one side of the inlet and outlet and the two segmental baffles 66 and 67 on the other side of the inlet and outlet. Fluid entering shell inlet 64 thus flows toward tube sheet 58, passes upwardly parallel to it, flows over longitudinal baffle member 69, and then passes downwardly between baffle 71 and the next baffle. Similarly, fluid flowing downwardly parallel to baffle 71 flows beneath longitudinal baffle member 70, passes upwardly parallel to tube sheet 58, and then flows beneath longitudinal baffle 60 into shell outlet 65. The baffles are spaced at substantially equal intervals along the length of the exchanger and hence the dead spaces normally present in shell and tube exchangers are substantially eliminated by the exchangers of the invention. This results in better heat transfer and less corrosion than might otherwise be encountered. It also reduces the overall pressure drop through the unit and permits rotation of the tube bundle through 180° in order to increase tube life. These and other advantages of the improved exchangers of the invention make their use attractive in many process applications.

I claim:

1. In a shell and tube heat exchanger including a first tube sheet, a second tube sheet, a plurality of tubes extending between said first and second tube sheets, an outer shell surrounding said tubes and containing a shell inlet and a shell outlet, and a plurality of transverse baffles for directing the flow of shell side fluid between said shell inlet and said shell outlet, the improvement which comprises a first double segmented baffle positioned between said shell inlet and the adjacent tube sheet, a first longitudinal baffle member extending between said first double segmented baffle and the adjacent transverse baffle, a second double segmented baffle positioned between said shell outlet and the adjacent tube sheet, and a second longitudinal baffle member extending between said second double segmented baffle and the adjacent transverse baffle, said transverse and double segmented baffles being spaced at substantially equal intervals between said first and second tube sheets.

2. A heat exchanger as defined by claim 1 wherein said shell inlet is located near said first tube sheet and said shell outlet is located near said second tube sheet.

3. A heat exchanger as defined by claim 1 wherein said shell inlet and said shell outlet are both located near said first tube sheet and are separated by an elongated baffle extending longitudinally from said first tube sheet to a point near said second tube sheet.

4. A heat exchanger as defined by claim 1 wherein said transverse baffles have cuts extending parallel to said shell inlet and said shell outlet and the cuts on adjacent transverse baffles are located 180° from one another.

5. A heat exchanger as defined by claim 1 wherein said double segmented baffles have cuts extending parallel to one another.

6. A heat exchanger as defined by claim 1 wherein said longitudinal baffle members extend between parallel cuts on said double segmented baffles and said transverse baffles.

7. A heat exchanger as defined by claim 1 wherein said tubes adjacent said shell inlet are provided with protective members facing the shell inlet.

8. A tube bundle for a shell and tube heat exchanger having an external shell containing a shell side fluid inlet and a shell side fluid outlet which comprises a first tube sheet; a second tube sheet; a plurality of elongated tubes extending between said first tube sheet and said second tube sheet; a plurality of segmented transverse baffles mounted on said tubes between said first and said second tube sheets, said transverse baffles having parallel cuts and the cut on each transverse baffle being located 180° from those on the adjacent transverse baffles; a double segmented baffle located between said transverse baffles and at least one of said tube sheets, said double segmented baffle having cuts extending parallel to the cuts on the adjacent transverse baffle; and a longitudinal baffle member extending between the cut on the transverse baffle adjacent said double segmented baffle and the corresponding cut on said double segmented baffle, the spacing between said transverse and double segmented baffle and that between said double segmented baffle and said tube sheet being substantially the same as that between adjacent transverse baffles.

9. A tube bundle as defined by claim 8 including a double segmented baffle located between said transverse baffles and each of said tube sheets and a longitudinal baffle member extending between the cut on the transverse baffle adjacent each of said double segmented baffles and the corresponding cut on each of said double segmented baffles.

10. A tube bundle as defined by claim 8 wherein one of said tube sheets is a floating tube sheet.

* * * * *